US005581961A

United States Patent [19]

Nanayakkara

[11] Patent Number: 5,581,961

[45] Date of Patent: Dec. 10, 1996

[54] PORTAL FRAME SYSTEM

[76] Inventor: Lakdas Nanayakkara, 22822 Pinewood Ct., Boca Raton, Fla. 33433

[21] Appl. No.: 169,989

[22] Filed: Dec. 16, 1993

Related U.S. Application Data

[63] Continuation-in-part of Ser. No. 987,045, Dec. 7, 1992, abandoned.

[51] Int. Cl.[6] ..... E04B 1/41

[52] U.S. Cl. ..... 52/93.2; 52/250; 52/639

[58] Field of Search ..... 52/93.1, 93.2, 52/250, 251, 639

[56] References Cited

U.S. PATENT DOCUMENTS

| | | | |
|---|---|---|---|
| 907,554 | 12/1908 | Ansbach | 52/93.1 |
| 1,378,448 | 5/1921 | Gilbert | 52/93.1 |
| 2,390,180 | 12/1945 | Sahlberg | 52/93.1 X |
| 2,409,383 | 10/1946 | Pedersen | 52/93.1 |
| 2,989,154 | 6/1961 | Colby | 52/93.1 |
| 3,146,864 | 9/1964 | Nystrom | 52/93.2 |
| 3,381,985 | 5/1968 | Anttila | 52/93.1 X |
| 3,601,939 | 8/1971 | Clyne | 52/93.1 |
| 3,846,953 | 11/1974 | Hodess | 52/93.1 X |
| 3,943,672 | 3/1976 | O'Sheeran | 52/93.1 X |
| 4,041,659 | 8/1977 | McElhoe | 52/93.1 |
| 4,315,386 | 2/1982 | Clarke | 52/93.1 |
| 4,342,177 | 8/1982 | Smith | 52/93.1 |
| 4,748,784 | 6/1988 | Dividoff | 52/639 |
| 4,773,192 | 9/1988 | Andrews | 52/639 X |
| 4,782,641 | 11/1988 | Manenti | 52/639 |
| 4,815,242 | 3/1989 | Gilliland | 52/90.1 |
| 4,862,653 | 9/1989 | Pomento | 52/93.1 |
| 5,133,162 | 7/1992 | Nelson | 52/93.1 X |
| 5,159,792 | 11/1992 | Pomento | 52/639 X |

FOREIGN PATENT DOCUMENTS

| | | | |
|---|---|---|---|
| 604111 | 4/1960 | Italy | 52/93.2 |
| 570151 | 6/1945 | United Kingdom | 189/21 |

*Primary Examiner*—Carl D. Friedman
*Assistant Examiner*—Beth A. Aubrey
*Attorney, Agent, or Firm*—Melvin K. Silverman

[57] ABSTRACT

A precast concrete portal frame system includes two column sections and a rafter section, each of which are pre-cast off-site, each column section extending integrally toward a plane of symmetry of the portal frame to an uppermost articulated surface of each of the column sections which meet lowermost articulated surfaces of the rafter section, defining respectively opposing planes in complemental keyed relationship, the opposing planes also defining, in longitudinal cross-section, mating L-shaped surfaces, the inclined planes of the column and rafter sections provided with transverse bolting holes to provide a bolted connection between the rafter and column sections of the system. The upper part of each column section is enlarged to provide resistance to high bending moments.

14 Claims, 10 Drawing Sheets

43

43

43

PORTAL FRAME SYSTEM

REFERENCE TO RELATED APPLICATION

This case is a continuation-in-part of application Ser. No. 07/987,045, filed Dec. 7, 1992 abandoned.

BACKGROUND OF THE INVENTION

The present invention relates to pre-cast concrete building components capable of assembly into constructional superstructures. The invention, more particularly, relates to a pre-cast portal frame adapted for manufacture as discreet components to thereby provide for later assembly at a construction site.

The use of concrete portal frames in building construction is well known. However, the use of such concrete portal frames has not become wide spread due to the high cost of erecting a monolithic concrete portal unit. Such a monolithic unit is awkward to cast at the site of construction and is cumbersome to erect. Further, if it is poured at a distance from the construction site, the transportation thereof is costly.

Concrete portal frames of the inventive type may be employed either to define an entrance to a structural wall or, alternatively, to provide a means for bearing the overall weight of the roof of the structure.

The prior art, as best known to the inventor, is represented by U.S. Pat. No. 2,409,383 (1946) to Pedersen, entitled Frame Structure. Pederson, however, relates to woodframe construction, as opposed to pre-cast concrete construction which is the focus of the instant invention. Further, Pederson does not provide for the form of key interlock taught by the within invention.

Other prior art known to the applicant is U.S. Pat. No. 4,725,611 (1985) to Basset; U.S. Pat. No. 4,815,242 (1986) to Gilliland; and U.S. Pat. No. 4,435,938 (1986) to Scott.

Other, further removed prior art known to the applicant is French Patent No. 2,587,745 (1987) to Gonzalez; and Czech Patent No. 78832 (1950) to Kozeny.

It is in response to the long felt need for a prefabricated, pre-cast concrete portal frame system that the present invention is directed.

Other prior art known to the applicant comprises United Kingdom Patent No. 570,151 (1943) to Dingsdale. Said patent relates to an improvement in the construction of greenhouses and the like, and differs from applicant's structure in that it does not provide any enlarged dimension at the upper portion of the vertical portions thereof or at the apex to thereby buttress against bending moments to which any such resultant system is susceptible.

SUMMARY OF THE INVENTION

A portal frame system includes a rafter section having an apex passing through a plane of symmetry of the rafter section, said section having left and right arms depending integrally downwardly relative to said plane of symmetry and away from said apex, said arms terminating in respectively articulated inclined surfaces having first complemental connection means therein. The inventive portal frame system also includes respective left and right column sections, each having an upper portion extending integrally upwardly and towards said plane of symmetry, and having an area of transition between vertical portions of said sections and said upper portions of said sections. An area of transition is defined between said vertical and upper portions of said column sections in which said area defines a greatest cross-sectional dimension of between about 1.5 and about 3.0 times the transverse dimension of said vertical portions of the column sections. Each of the upper portion of the column sections terminate in an articulated incline surface complemental in geometry to a corresponding surface of said articulated incline surfaces of said arms of said rafter section. Said upper portions including second complemental connection means alignable with and securable to said first complemental connection means of said arms of said rafter sections. Upon connection of said first and second complemental connection means, a resultant structure thereof will form a unitary portal frame system.

It is, accordingly, an object of the present invention to provide a concrete portal frame adapted for manufacture at a location remote from a construction site.

It is another object of the invention to provide a pre-cast concrete component capable of assembly, at a work site, into a building superstructure.

It is a further object to provide a pre-cast concrete portal frame system capable of enhancing ease of assembly of portal aspects of a superstructure.

It is a yet further object of the invention to provide a portal frame of the above type that have maximum resistance to bending moments under worst conditions of loading of the overall structure.

The above and yet other objects and advantage of the present invention will become apparent from the hereinafter set forth Brief Description of the Drawings, Detailed Description of the Invention and Claims appended herewith.

DETAILED DESCRIPTION OF THE INVENTION

Figure 1:
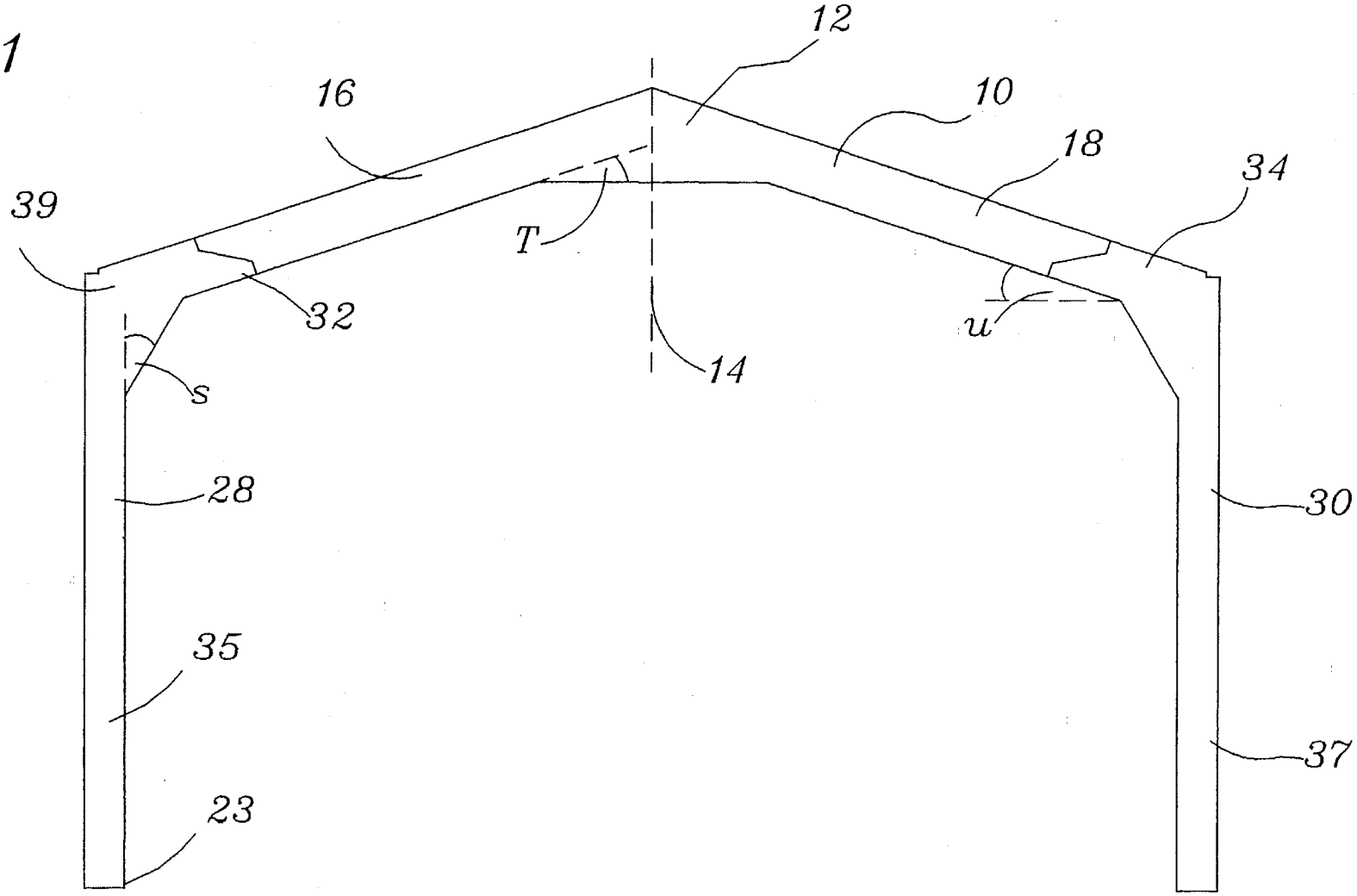
FIG. 1 is a view of a concrete portal frame in accordance with a first embodiment of the present invention.

With reference to the view of FIG. 1, the present inventive portal frame system may be seen to include a rafter section 10 having a central apex 12 which passes through a plane of symmetry 14 and is symmetrical thereabout. As may be further noted in the view of FIG. 1, said rafter section 10 also includes left and right arms 16 and 18 which depend symmetrically downwardly from said apex.

Figure 2:
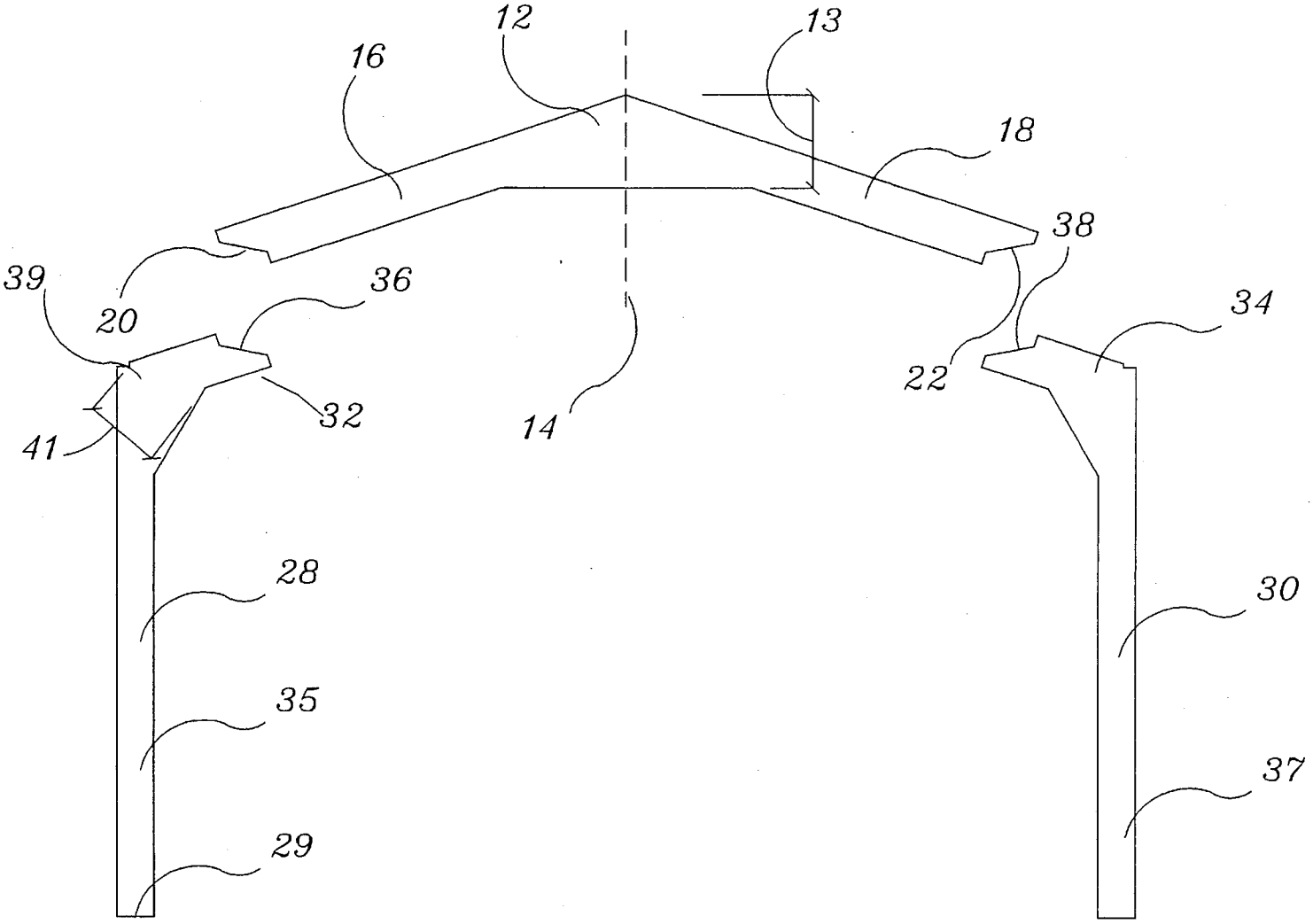
FIG. 2 is an exploded view of the portal frame of FIG. 1.

With reference to FIG. 2, each of the arms 16 and 18 terminate in respective articulated inclined surfaces 20 and 22 having therethrough bolting holes 24 (see FIG. 4), later more fully described below. It is to be appreciated that said articulating surfaces 20 and 22 are essentially L-shaped such that said bolting holes 24 pass through a major base of each L-shaped surface 20 and 22. Also, minor bases 25 and 26 of the L-shaped surfaces 20 and 22 perform a blocking/stability enhancing function after the components are assembled.

Figure 4:
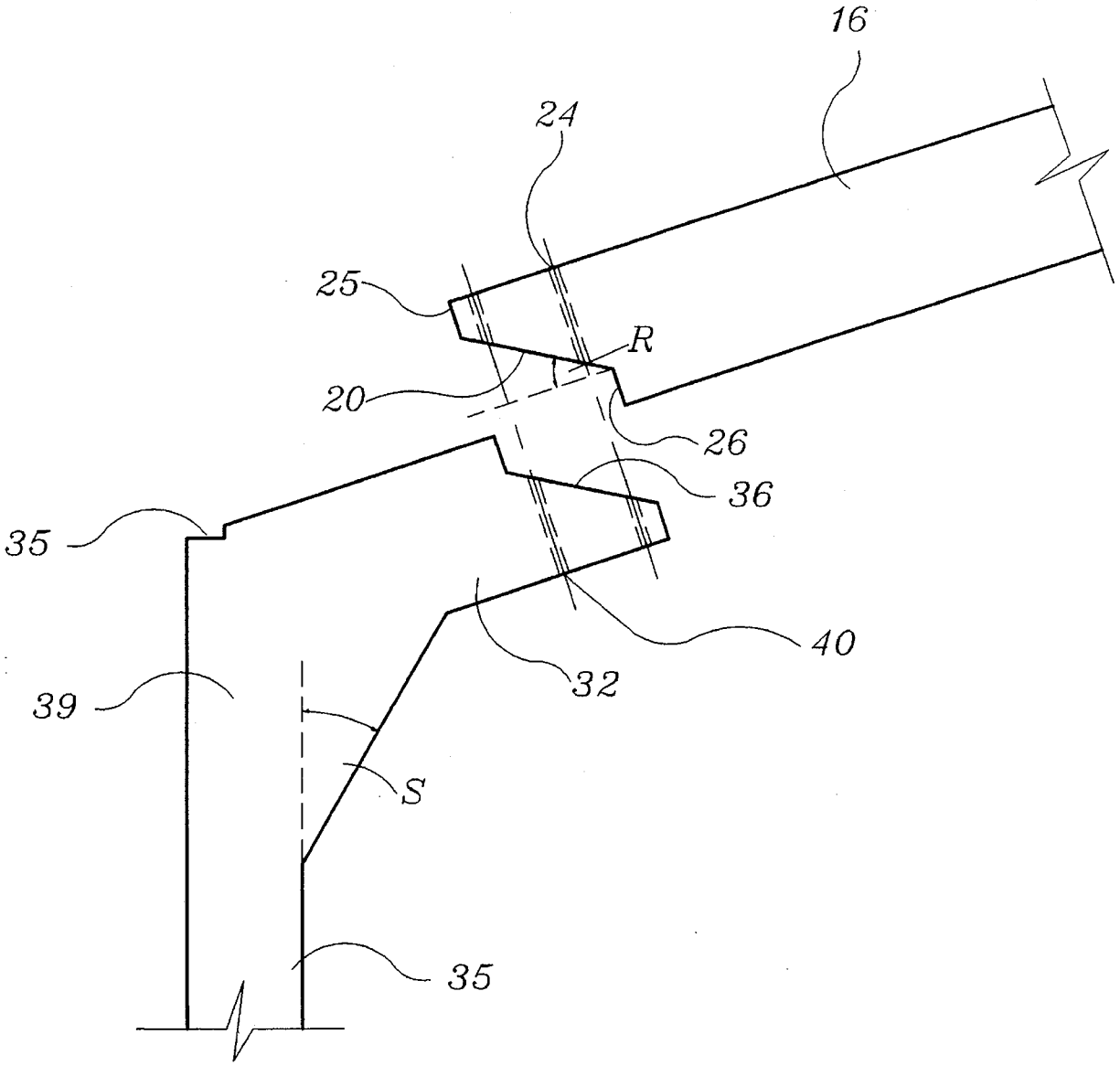
FIG. 4 is an enlarged view of an incline plane interface between the column and rafter sections of the portal frame showing the key joint, bolted connection therebetween.

With further reference to FIGS. 1, 2 and 4, the inventive portal frame system may be seen to further include respective left and right column sections 28 and 30, each of said sections having respective upper portions 32 and 34, and vertical portions 35 and 37. As may be noted in FIG. 1, said left and right column sections 28 and 30, including their respective upper portions 32 and 34, may be symmetric relative to said plane of symmetry 14.

With further regard to FIGS. 1 and 2, it may be noted that said respective upper portions 32 and 34 of said column sections extend integrally upwardly and in the direction of said plane of symmetry 14, wherein each of said upper portions terminate in respective articulated surfaces 36 and 38. As may be noted in the views of FIGS. 2 and 4, the geometry of said pairs of articulated surfaces 20 and 36, and surfaces 22 and 38, are complementally keyed to each other such that upon passing bolts through said holes 24 and holes 40 provided in said incline surface 36 of said upper portion 32 of the column sections, the bolted members will be stably secured to each other.

With further reference to apex 12 of the rafter section 10, said section defines a linear dimension 13 (see FIG. 2) which passes through apex 12 thereof at said plane of symmetry 14. Said linear dimension 13 is in the range of about 1.5 to about 3.0 times the transverse cross-section of arms 16 and 18 of the rafter section.

With further reference to FIGS. 1, 2 and 4 it is noted that, between said upper portion 32 and vertical portion 35 of the column section 28, is an area of transition 39 therebetween which area, at dimension 41 (see FIG. 2) defines a greatest cross-section of between about 1.5 to about 3.0 times the transverse dimension of said vertical portion 35 of the column section 28. The same relationship exists with regard to the area of transition relative to right column section 30. Such an enlarged area of the column section is necessary due to the increased bending moment distribution 27 which exists at the top of the vertical portions 35 and 37 of the column sections. See particularly the schematic diagram of FIG. 3. It may further be noted therein that point 42 represents the point of least bending moment. Accordingly, said point 42 corresponds to the location of surfaces 20/36 and 22/38 at which the rafter section is secured to the respective column sections 28 and 30.

With further reference to FIGS. 1 and 4, it may be noted that an inner perimeter of area of transition 39 defines an Angle S which is in the range of about six to about fifteen degrees relative to the longitudinal axis of vertical portion 35 of the column section.

A further material relationship with reference to the apex 12 of the rafter section is that there is defined an Angle T (see FIG. 1) between the lower horizontal perimeter of the apex and the longitudinal axis of the arms of the rafter section.

A further relationship of importance is that of an Angle U (see FIG. 1) which exists between the longitudinal axis of the rafter arms and the horizontal plane of the base 43 upon which the instant system is constructed. Said Angle U is preferably in the range of about seven to about forty-five degrees.

Figure 3:
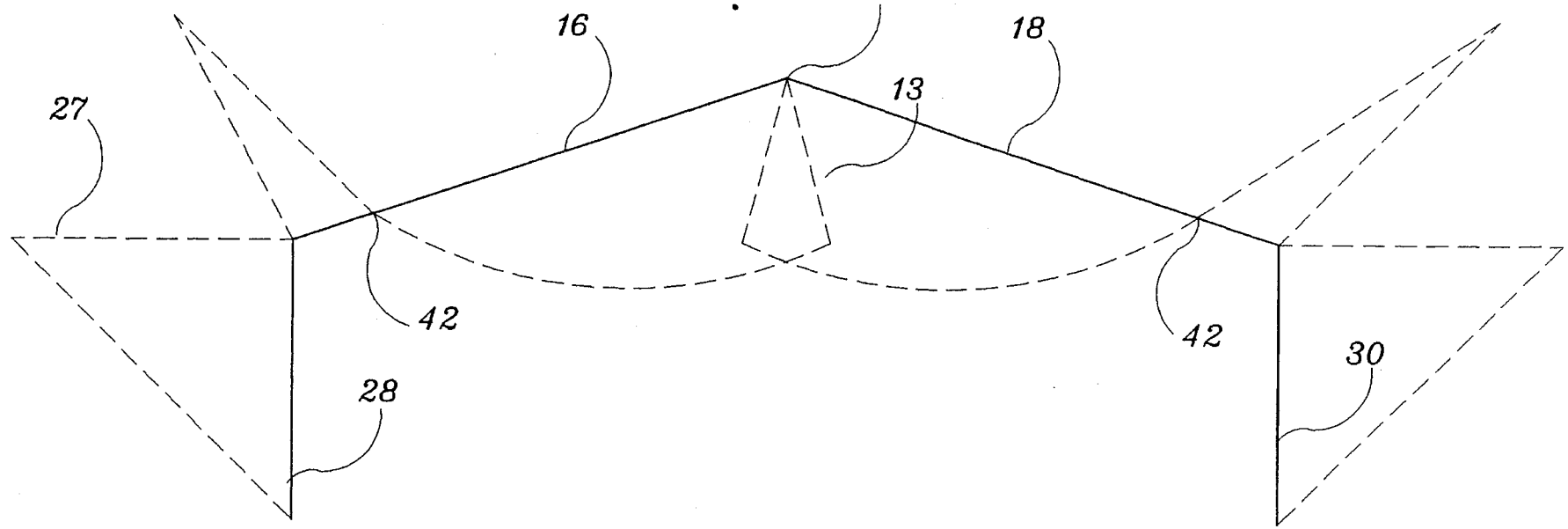
FIG. 3 a schematic diagram of the bending moment distribution on a portal frame resultant from uniformly distributed vertical loads thereupon.

With respect to FIG. 3 there is shown a schematic diagram of the bending moment distribution on a portal frame system due to an uniformly distributed load. Accordingly, it may be noted that points 42 represents the points of least bending moment. Accordingly, it is that point at which the interface between said surfaces 20 and 36, and surfaces 22 and 38, have been selected. Therefore, the minimum bending moment upon the portal frame structure will be at the point of the keyed bolted connections between the rafter section and the column sections.

It is noted at an Angle R in FIG. 4 that said major base of each inclined surface defines an angle of about 2.5 to about forty degrees relative to the longitudinal axis of each arm of the rafter section. Further, the axis of each rafter arm defines an angle of about 2.5 to about 40 degrees relative to the ground.

Figure 5:
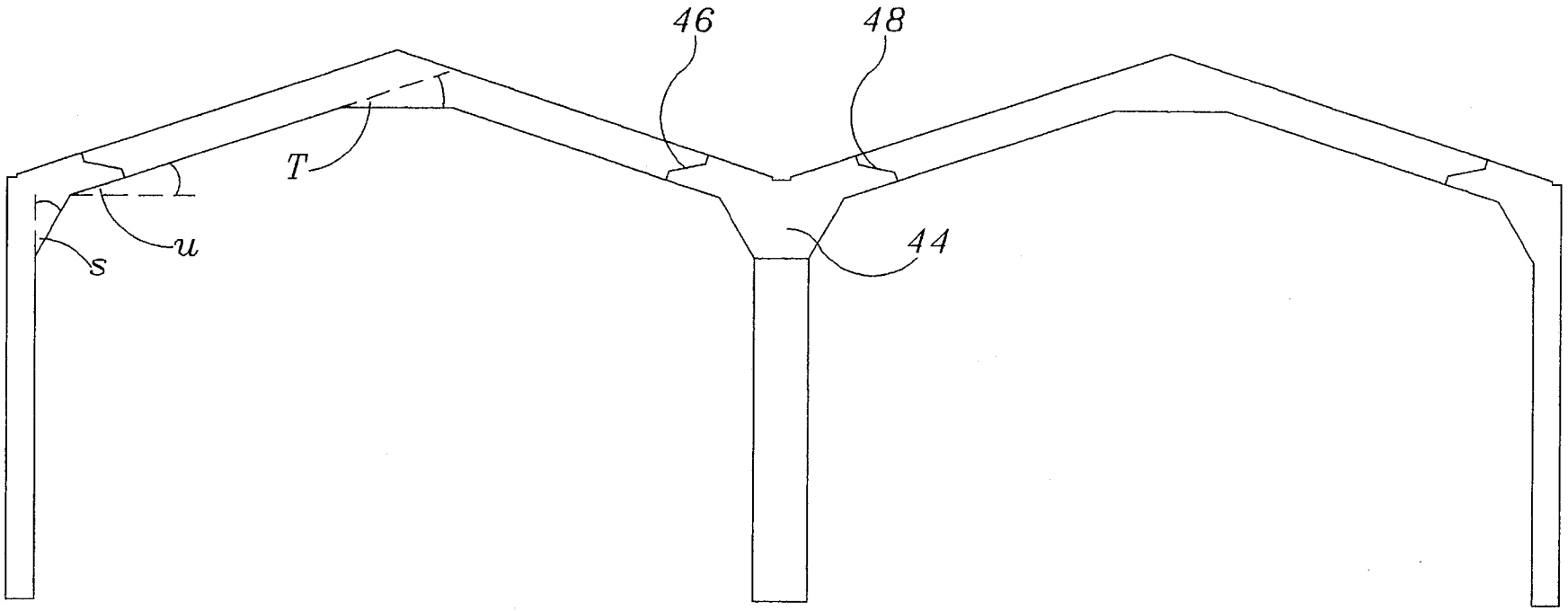
FIG. 5 is a view of a second embodiment of the invention showing use of the inventive portal frames in series.
Figure 6:
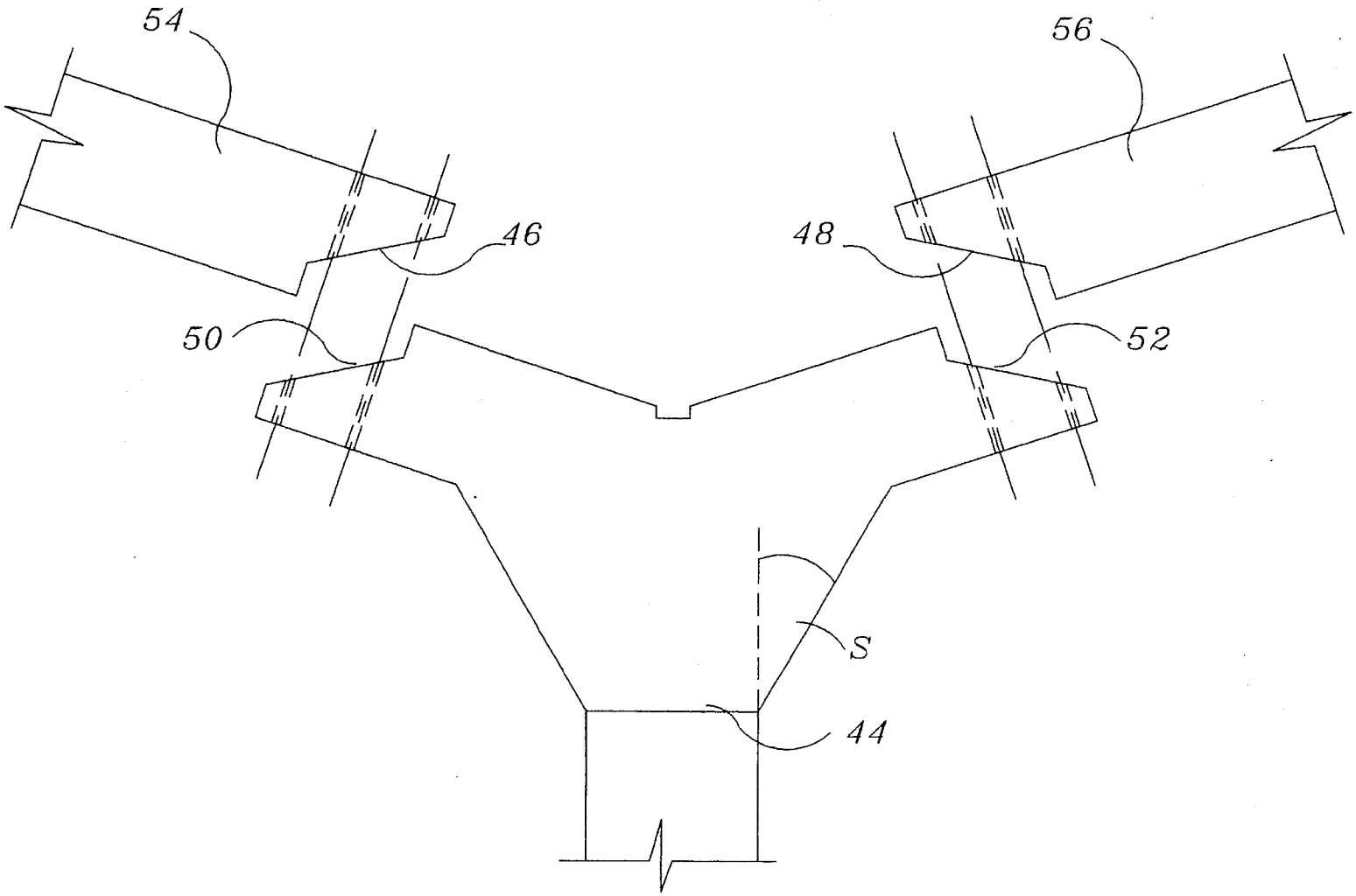
FIG. 6 is an exploded view of the embodiment of FIG. 5, otherwise similar to the view of FIG. 4.

With reference to the views of FIGS. 5 and 6, there is illustrated the manner in which the principles of the instant invention, as above described, may be extended to any number of portal frames in series. In such construction there is employed a special column upper portion 44 which is provided with articulated surfaces 46 and 48 to mate the articulated surfaces 50 and 52 of left and right rafter sections 54 and 56 in the same fashion as above described for a single portal element. Accordingly, it is to be appreciated that the instant invention is equally applicable to portal frames in series, as it is to individually independently employed portal units.

Figure 7:
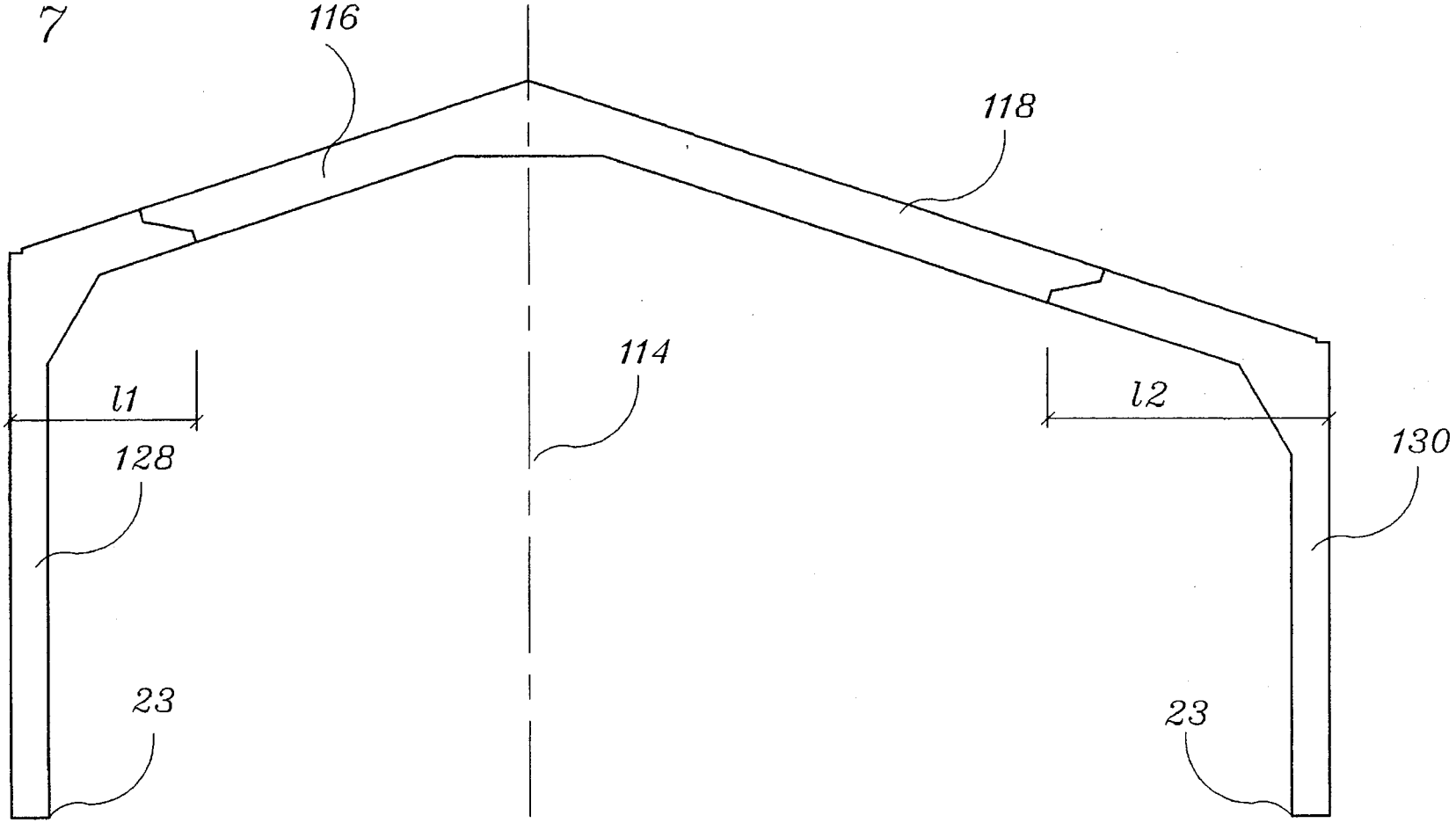
FIGS. 7 and 8 are views of an asymmetrical embodiment of the invention shown in FIGS. 1 and 2.
Figure 8:
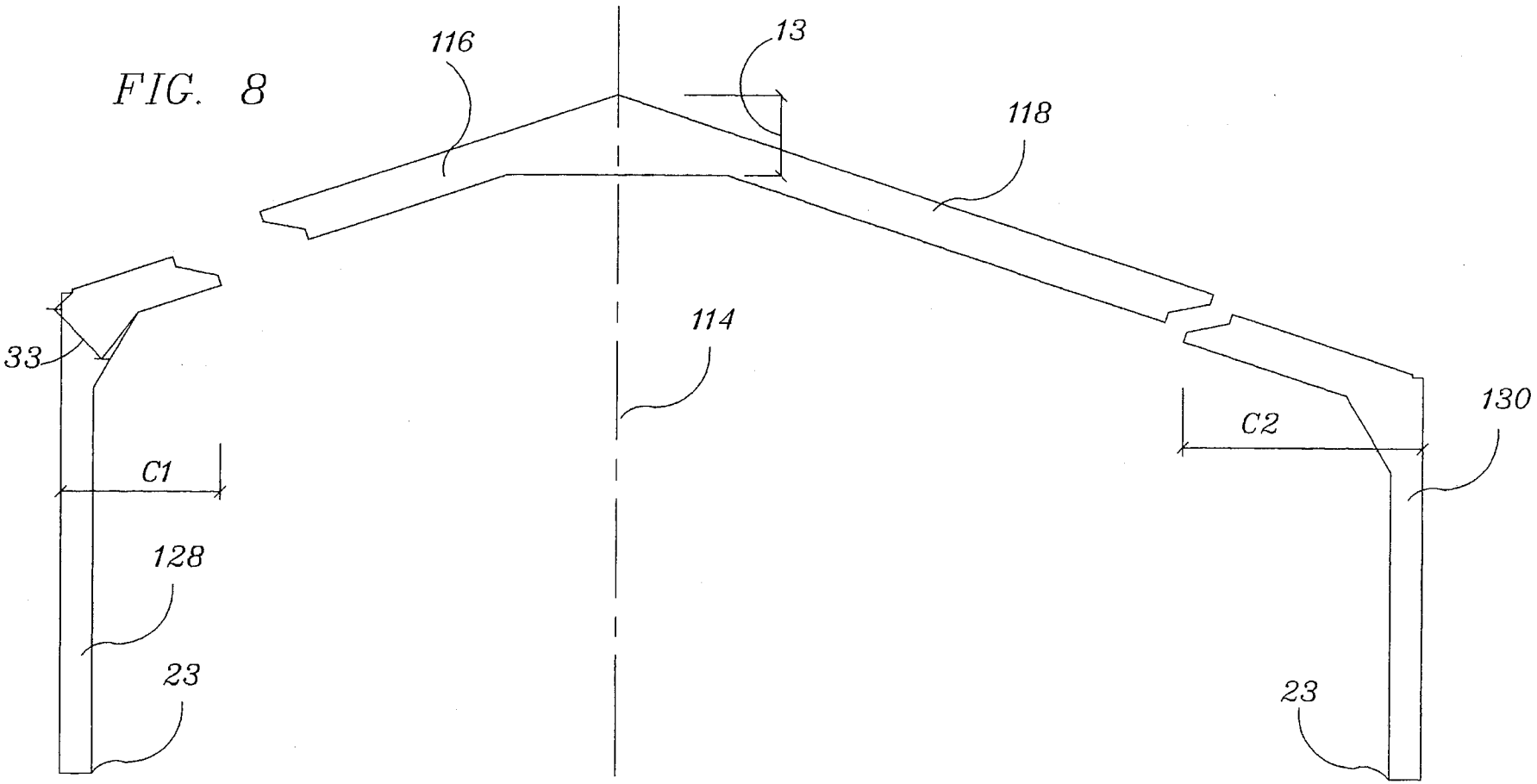
Figure 10:
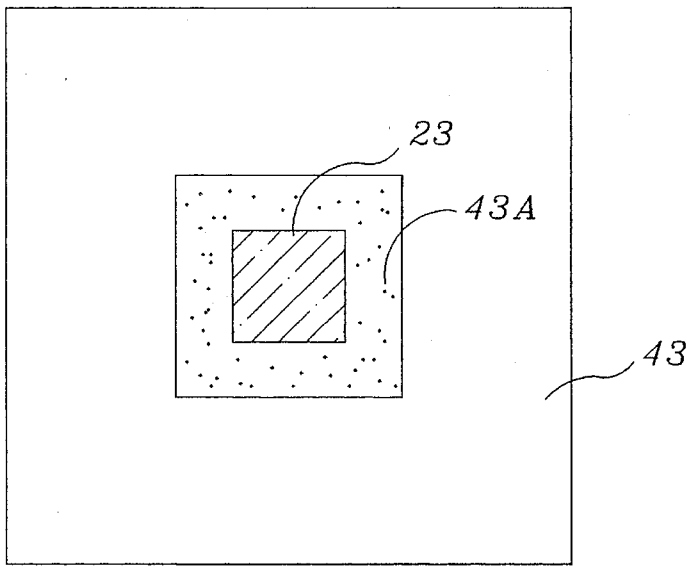
FIG. 10 is a cross-sectional view taken along lines 10—10 of FIG. 9.
Figure 9:
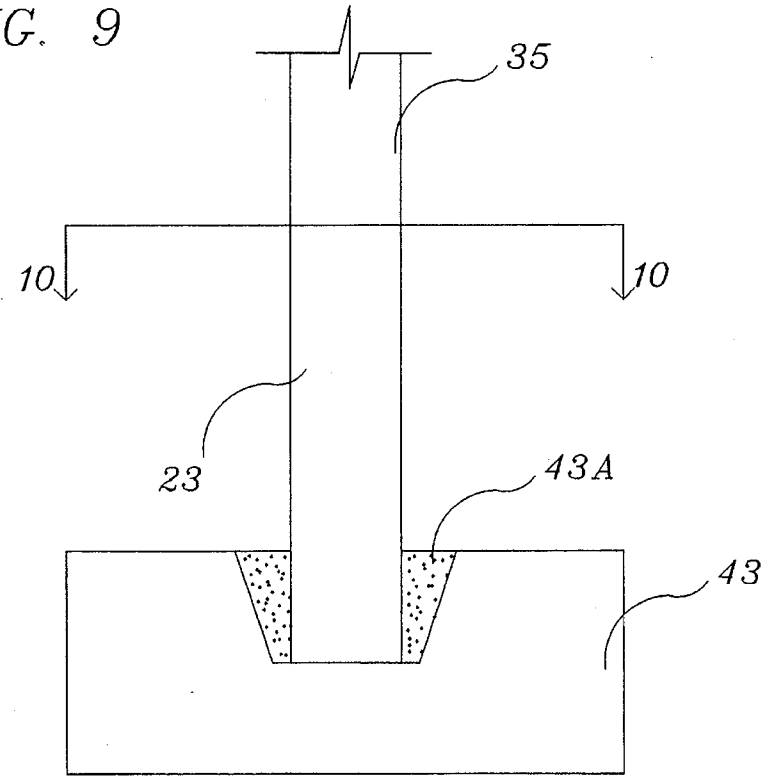
FIG. 9 is a vertical cross-sectional schematic view showing the method vertical portions of the left and right column sections to the base to which the instant system is to be secured.

In FIGS. 7 and 8 are shown an asymmetrical embodiment of the invention of FIGS. 1 and 2. Therein plane 114 is not equidistant between column sections 128 and 130, nor are arms 116 and 118 symmetric about plane 114. In all other respects the embodiment of FIG. 7 and 8 follows the principles of operation of the embodiment of FIGS. 1 and 2.

With respect to the method of manufacture of the instant invention it is, as noted in the Summary of the Invention above, contemplated that the respective column and rafter sections of the invention will be poured as reinforced pre-cast concrete elements at a site remote from the construction site such that, on an as-needed basis the particular elements can be transported to the construction site and easily assembled in view of the reduced weight and improved maneuverability which is a product of the practice of the invention system and method.

Figure 12:
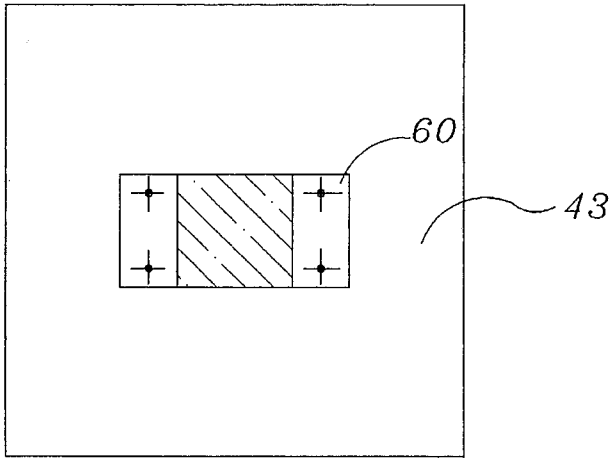
FIG. 12 is a cross sectional view along Line 12—12 of FIG. 11.
Figure 11:
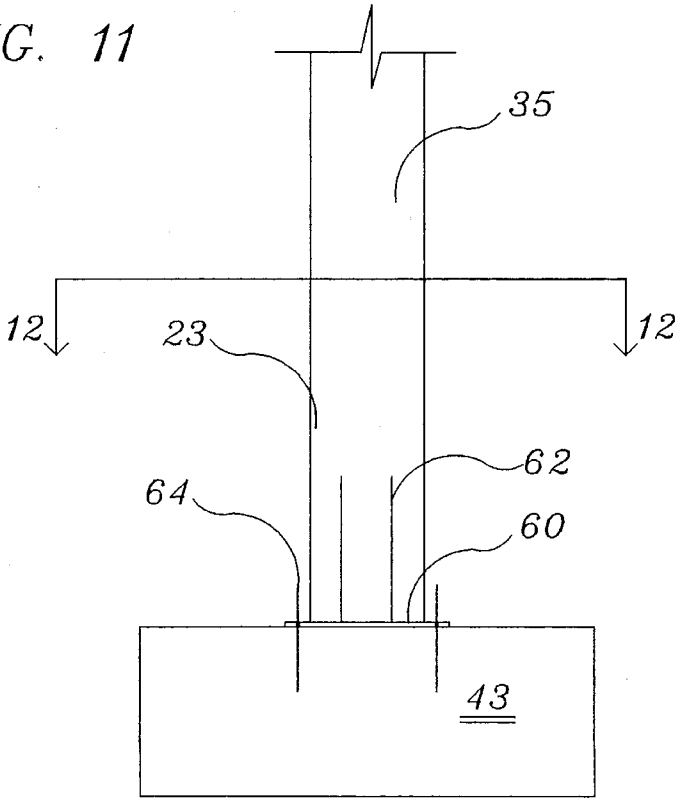
FIG. 11 is a view, similar to the view of FIG. 9, however showing an alternate method of securement to the system base.

In FIGS. 9 to 12 are shown methods by which the base of vertical column 23 may be secured into horizontal surface 43 using concrete 43A (FIG. 9–10) or angle irons 60 with vertical bolts 62 and 64 (FIGS. 11 and 12).

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. A portal frame construction system, comprising:

(a) a rafter section having an integral apex passing through a plane of symmetry of said rafter section, said section having left and right arms depending integrally downwardly relative to said plane of symmetry and away from said apex, said arms each terminating in a respectively articulated inclined surface comprising a central fastening surface defining, in vertical cross-section, a diagonal relative to a longitudinal axis defined by each of said rafter section arms, an outer end of each diagonal located above each arm axis and an inner end thereof located below each arm axis, said articulated inclined surface further comprising outer and inner transverse stabilizing surfaces, one each integrally depending from opposite ends of each of said central fastening surfaces in which each of said stabilizing surfaces is substantially transverse to each respective rafter arm axis, each fastening surface having first complemental connection means therein; and (b) respective left and right column sections, each having an upper portion extending integrally upwardly and toward said plane of symmetry and having an area of transition between vertical portions of each sections and upper portions thereof, said area of transition defining a greatest cross-sectional dimension of between about 1.5 and about 3.0 times the transverse dimension of the said vertical portions of each column section, and each of said upper portions terminating in an articulated inclined surface complemental to corresponding opposing surfaces of said articulated inclined surfaces of said respective arms of said rafter section, said upper portions of each of said columns including second complemental connection means alignable with and securable to said first complemental connection means of each of said fastening surfaces of each of said articulated inclined surfaces of each of said arms of said rafter section, whereby upon connection of said first and second complemental connection means, said respective articulated inclined surfaces become secured to each other, a resultant structure thereof forming a unitary portal frame construction system.

2. The system as recited in claim 1, in which an angle of each of said respective central fastening surfaces of said articulated inclined surfaces of said arms of said rafter section to said longitudinal axes of each of said rafter section arms is in the range of about 2.5 to about 40 degrees.

3. The system as recited in claim 1, in which an angle of said respective incline surfaces of said arms of said rafter sections to said longitudinal axis of said sections is in the range of about 2.5 to about 40 degrees.

4. The system as recited in claim 1, in which an inner perimeter, of said area of transition between said vertical and upper portions of said column sections, defines an angle in the range of about six to about fifteen degrees relative to a longitudinal axis of said vertical portions of said column sections.

5. The system as recited in claim 1, which a lower base of said apex of said rafter section defines an angle in the range of about six to about 15 degrees relative to a longitudinal axis of said arms of said rafter sections.

6. The system as recited in claim 1,in which an angle in the range of about seven to about forty-five degrees is defined between a longitudinal axis of said arms of said rafter section and the horizontal plane, of said system.

7. The system as recited in claim 1, in which said rafter and column sections comprise pre-cast steel reinforced concrete elements.

8. A portal frame construction system, comprising:

(a) a rafter section having an internal apex passing through a plane of symmetry of said rafter section, said section having left and right arms depending integrally downwardly relative to said plane of symmetry and away from said apex, said arms each terminating in a respectively articulated inclined surface comprising a central fastening surface defining, in vertical cross-section, a diagonal relative to a longitudinal axis defined by each of said rafter section arms, an outer end of each diagonal located above each arm axis and an inner end thereof located below each arm axis, said articulated inclined surface further comprising outer and inner transverse stabilizing surfaces, one each integrally depending from opposite ends of each of said central fastening surfaces in which each of said stabilizing surfaces is substantially transverse to each respective rafter arm axis, each fastening surface having first complemental connection means therein; and (b) respective left and right column sections, each having an upper portion extending integrally upwardly and toward said plane of symmetry and having an area of transition between vertical portions of each sections and upper portions thereof, said area of transition defining a greatest cross-sectional dimension of between about 1.5 and about 3.0 times the transverse dimension of the said vertical portions of each column section, and each of said upper portions terminating in an articulated inclined surface complemental to corresponding opposing surfaces of said articulated inclined surfaces of said respective arms of said rafter section, said upper portions of each of said columns including second complemental connection means alignable with and securable to said first complemental connection means of each of said fastening surfaces of each of said articulated inclined surfaces of each of said arms of said rafter section, a centerline of said articulated inclined surfaces, transverse to said longitudinal axis of said rafter section arms, situated in a range of about twelve to about fifty percent of the aggregate length, when joined, of each upper portion of each column section and each corresponding arm of each respective rafter section, whereby upon connection of said first and second complemental connection means, said opposing articulated inclined surfaces are secured to each other, a resultant structure thereof forming a unitary portal frame construction system.

9. The system as recited in claim 8, in which an angle of each of said respective central fastening surfaces of said articulated inclined surfaces of said arms of said rafter sections to said longitudinal axis of said rafter section arms is in the range of about 2.5 to about 40 degrees.

10. The system recited in claim 9, in which said range of position of said centerline of said articulated incline surfaces to said longitudinal axes is in the range of about 20 to about 30 degrees.

11. The system as recited in claim 9, in which an inner perimeter of said area of transition between said vertical and upper portions of said column sections, subtends an angle in a range of about 6 to about 15 degrees relative to a longitudinal axis of said vertical portion of said column sections.

12. The system as recited in claim 9, in which a lower base of said apex of said rafter section subtends an angle in a range of about six to about fifteen degrees relative to said longitudinal axes if said arms of said rafter sections.

13. The system as recited in claim 9, in which an angle in a range of about 7 to about 45 degrees is defined between said longitudinal axes of said arms of said rafter section and a horizontal plane of said system.

14. The system as recited in claim 9, in which said rafter and column sections each comprise steel reinforced pre-cast concrete elements.

* * * * *